United States Patent [19]

Maurer et al.

[11] Patent Number: 4,828,053

[45] Date of Patent: May 9, 1989

[54] DEVIATED WELLBORE DRILLING SYSTEM AND APPARATUS

[75] Inventors: William C. Maurer; William J. McDonald, both of Houston, Tex.

[73] Assignee: Maurer Engineering, Inc., Houston, Tex.

[21] Appl. No.: 143,005

[22] Filed: Jan. 12, 1988

[51] Int. Cl.[4] ..... E21B 4/02

[52] U.S. Cl. ..... 175/75; 175/107

[58] Field of Search ..... 175/61, 73, 75, 107, 175/92, 320; 418/48, 182; 415/502

[56] References Cited

U.S. PATENT DOCUMENTS

| | | | |
|---|---|---|---|
| 3,260,318 | 7/1966 | Neilson et al. | 175/107 |
| 3,667,556 | 6/1972 | Henderson | 175/73 |
| 4,067,404 | 1/1978 | Crase | 175/75 |
| 4,445,578 | 5/1984 | Millheim | 175/61 X |
| 4,577,701 | 3/1986 | Dellinger et al. | 175/61 |
| 4,629,012 | 12/1986 | Schuh | 175/75 |
| 4,653,598 | 3/1987 | Schuh et al. | 175/75 |
| 4,667,751 | 5/1987 | Geezy et al. | 175/61 |
| 4,679,638 | 7/1987 | Eppink | 175/107 |
| 4,739,842 | 4/1988 | Kruger et al. | 175/61 |

FOREIGN PATENT DOCUMENTS

| | | |
|---|---|---|
| 109699 | 5/1984 | European Pat. Off. . |
| 1494273 | 12/1977 | United Kingdom . |

OTHER PUBLICATIONS

Brassfield et al., "Drill Faster, More Accurately with New Navigation System", *World Oil,* Aug. 1, 1985.

Bayne, "Navigation Drilling Technology Progresses", *Drilling,* Nov./Dec. 1986.

Hall, "Steerable System Saves Time in Straight-Hole Drilling", *Petroleum Engineer International,* Sep. 1987.

Easterling et al., "Steerable System Optimizes Drilling Time", *Offshore,* Aug. 1987.

Pruitt et al., "Drilling With Steerable Motors in Large Diameter Holes", IADC/SPE Drilling Conference, Feb. 1988.

Nortech, "New Drilling System Achieves Faster, Less Expensive Hole", Norton Christensen, Fall 1985.

Short, "Drilling-A Source Book on Oil and Gas Well Drilling From Exploration to Completion", PennWell Books, pp. 429, 430.

Kennedy, "Fundamentals of Drilling-Technology and Economics", PennWell Books, p. 147.

Adams, "Drilling Engineering-A Complete Well Planning Approach", PennWell Books, pp. 349-351.

Bourgoyne, Jr. et al., "Applied Drilling Engineering", Society of Petroleum Engineers, 1986, pp. 375-377.

"A Primer of Oilwell Drilling-Third Edition", Petroleum Extension Service Industrial and Business Training Bureau, pp. 70 and 71.

Tiraspolsky, "Hydraulic Downhole Drilling Motors", Gulf Publishing Company, pp. 189-191.

*Primary Examiner*—Hoang C. Dang

*Attorney, Agent, or Firm*—Neal J. Mosely

[57] ABSTRACT

A deviated wellbore drilling system suitable for drilling curved wellbores which have a radius of curvature of approximately 200 to 1,000 feet relative to a vertical or near vertical wellbore comprises a drill string, a drill bit, and a fluid-operated drill motor having a curved or bent housing section for rotating the drill bit independently of the drill string. The drilling motor has an elongate tubular rotor/stator drive section containing a rubber stator and a steel rotor and the housing is bent or curved intermediate its ends. A straight or bent univeral section below the bent or curved rotor/stator section contains a universal joint for converting orbiting motion of the rotor to concentric rotary motion at the bit, and a bearing pack section below the universal section contains radial and thrust bearings to absorb the high loads applied to the bit.

16 Claims, 2 Drawing Sheets

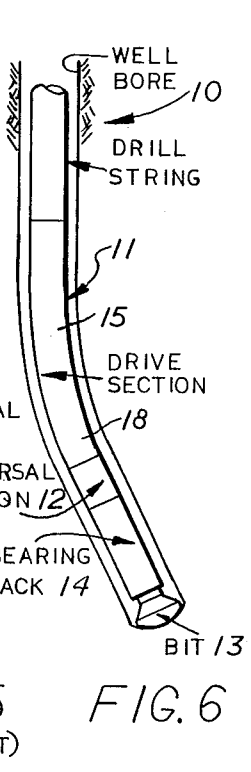
FIG. 6
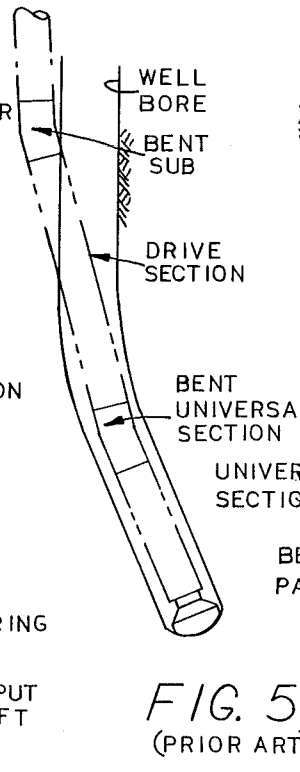
FIG. 5 (PRIOR ART)
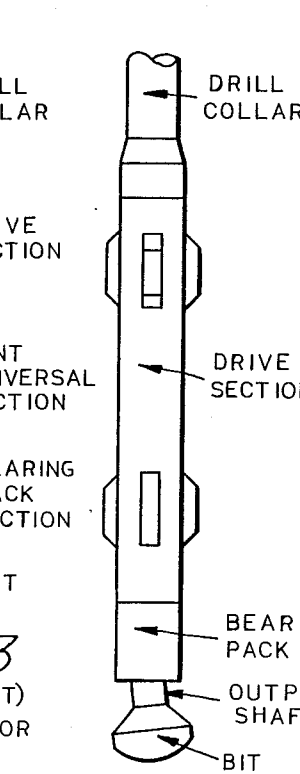
FIG. 4 (PRIOR ART) INCLINED SHAFT/BIT
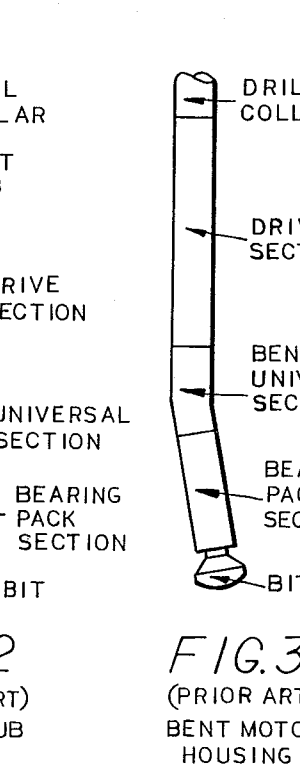
FIG. 3 (PRIOR ART) BENT MOTOR HOUSING
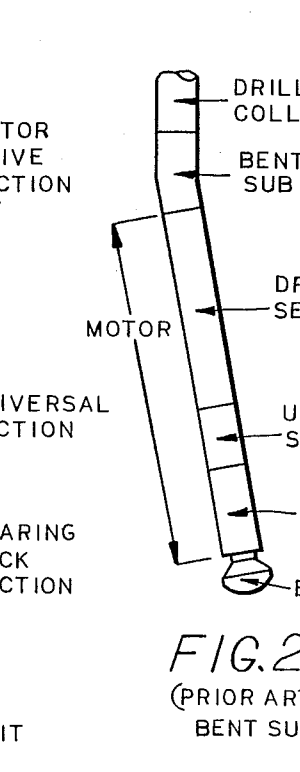
FIG. 2 (PRIOR ART) BENT SUB
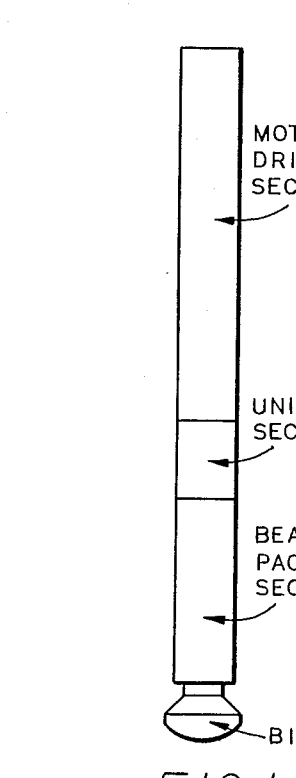
FIG. 1 (PRIOR ART) STRAIGHTHOLE MOTOR

DEVIATED WELLBORE DRILLING SYSTEM AND APPARATUS

BACKGROUND OF THE INVENTION

1. FIELD OF THE INVENTION

This invention relates generally to improvements in well drilling system and apparatus, and more particularly to downhole drilling motor apparatus having a bent or curved drive section.

2. BRIEF DESCRIPTION OF THE PRIOR ART

It has been recognized that a number of advantages can be gained in drilling wells by employing a stationary drill pipe or drill string which has attached at its lower end a downhole motor, the drive section of which is connected to and rotates a drill bit. In such apparatus a fluid, e.g., air, foam, or a relatively incompressible liquid, is forced down the stationary drill pipe or drill string and on passing through the fluid-operated motor causes rotation of a shaft ultimately connected to the drilling bit. The drill string is held or suspended in such a manner that it does not rotate and therefore may be regarded as stationary. However, it is lowered in the well as drilling proceeds.

The forces required to rotate the rotary bit at the bottom of the string are such that in the usual situation the fluid operated motor must be quite lengthy. Conventional straight hole drilling motors such as the Moineau (Moyno) motor comprise three sections, the rotor/stator section which contains a rubber stator and steel rotor; the universal section which contains the universal joint or flexible connection that converts the orbiting motion of the rotor to the concentric rotary motion of the bit; and the bearing pack section which contains radial and thrust bearings to absorb the high loads applied to the drill bit. The rotor/stator section of the motor is typically 2–3 times longer than the bearing pack section.

In directional drilling, drilling motors of this general character are utilized wherein a bend may be located in the drill string above the motor, a bend may be placed in the motor housing below the rotor/stator drive section, or the bit or output shaft is angularly offset relative to the drive section axis.

In some directional drilling systems, such as Dellinger et al., U.S. Pat. No. 4,577,701 and British Patent No. 1,494,273, the practice has been to position a "bent sub" between the top of the fluid-operated motor and the axis of rotation of the bit to the axis of the drill pipe. However, due to the length of the motor required and other structure connecting the rotor of the motor to the bit, the spacing of the "bent sub" from the bit is excessive. This distance frequently amounts to approximately 22 feet or more which is objectionable due to the fact that it is difficult to position and to maintain the orientation of the bit in relation to the axis of the drill pipe.

In an attempt to overcome this problem other systems have been designed to place the bend closer to the bit, such as Nielson et al, U.S. Pat. No. 3,260,318.

These types of systems modify the universal section of the drilling motor. Because the lower end of the rotor in the aforementioned types of motors gyrate about the axis of its stator, some form of universal joint or flexible connection is employed in the driving connection between the rotor and the bit which rotates about a stationary axis. As a clearance must exist between this universal joint or flexible connection and the walls of the surrounding housing to accommodate the flexibility of movement, a bend is formed in the housing of the universal section of the motor. In this manner, the axis of rotation of the bit is angularly related not only to the axis of the drill string but also the axis of the fluid-operated motor. This aids in obtaining and maintaining control and orientation of the bit. However, placing the bend in the housing surrounding the universal joint limits the severity of the bend which can be used.

Other systems, such as Henderson, U.S. Pat. No. 3,667,556 and Kamp, European Patent No. 109,699 disclose apparatus wherein the drill bit or output shaft is angularly offset relative to the motor drive section axis.

Combinations of the above described prior art systems may also be used in directional drilling, however none utilize downhole fluid motors having a bent or curved rotor/stator section. Because the rotor/stator section of the motors are typically 2–3 times longer than the bearing section, the prior art systems are not particularly suitable for use in drilling high curvature horizontal wellbores, such as medium-radius (200 to 1,000 feet), from vertical or near vertical wells. The present invention may be used in conjunction with the prior art apparatus such as bent subs, bent housings, and inclined motor shafts.

The present invention is distinguished over the prior art in general, and these patents in particular by a system which utilizes a downhole fluid-operated motor having a bent or curved rotor/stator drive section which allows it to be used in high curvature wellbore applications without interfering with the wall of the borehole.

SUMMARY OF THE INVENTION

It is therefore an object of the present invention to provide a deviated wellbore drilling system for drilling curved wellbores which have a radius of curvature of from approximately 200 to 1,000 feet relative to a vertical or near vertical wellbore.

It is another object of this invention to provide a deviated wellbore drilling system which may be used in high curvature wellbore applications without interfering with the wall of the borehole.

Another object of this invention is to provide a deviated wellbore drilling system having a fluid-operated drill motor with a curved or bent drive section connected therebetween for rotating the drill bit independently of the drill string.

Another object of this invention is to provide a deviated wellbore drilling system which will reduce the problems associated with utilizing elongate straight fluid-operated drilling motors in directional drilling applications with little loss of power required to rotate the rotary bit at the bottom of the drill string.

Another object of this invention is to provide a deviated wellbore drilling system which will aid in obtaining and maintaining control and orientation of the drill bit.

A further object of this invention is to provide a deviated wellbore drilling system wherein a curve or bend is located in the drive section of the motor rather than in the drill string above the drive section or in the motor housing below the drive section to more effectively angularly offset the output shaft relative to the drive section axis.

A still further object of this invention is to provide a deviated wellbore drilling system which is simple in design, economical to manufacture, and reliable and durable in use.

Other objects of the invention will become apparent from time to time throughout the specification and claims as hereinafter related.

The above noted objects and other objects of the invention are accomplished by a deviated wellbore drilling system comprising a drill string, a drill bit, and a fluidoperated drill motor having a curved or bent drive section connected therebetween for rotating the drill bit independently of the drill string. The drilling motor has an elongate tubular rotor/stator drive section containing a rubber stator and a steel rotor and the housing is bent or curved intermediate its ends. The motor is preferably of a Moineau configuration. A straight universal section below the bent or curved rotor/stator section contains a flexible connection for converting orbiting motion of the rotor to concentric rotary motion at the bit, and a bearing pack section below the universal section contains radial and thrust bearings to absorb the high loads applied to the bit.

BRIEF DESCRIPTION OF THE DRAWINGS

FIG. 1 is a schematic side elevation of a conventional, prior-art straight hole fluid-operated drilling motor.

FIG. 2 is a schematic side elevation of a conventional drill string system of the prior art utilizing a "bent sub" located in the drill string above a straight fluid-operated motor.

FIG. 3 is a schematic side elevation of a conventional drill string system utilizing a "bent motor housing" located below the motor drive section and above the motor bearing pack section for use in directional drilling.

FIG. 4 is a schematic side elevation of a conventional drill string system of the prior art utilizing a straight hole fluid-operated drilling motor with the drill bit axis angularly offset from the axis of the motor.

FIG. 5 is a schematic side elevation illustrating the problem encountered with conventional drill string systems which utilize a straight hole fluid-operated drilling motor.

FIG. 6 is a schematic side elevation of the present system illustrating how a motor having a bent or curved drive section overcomes the problem encountered with the prior art drill string systems.

DESCRIPTION OF THE PREFERRED EMBODIMENT

Figure 9:
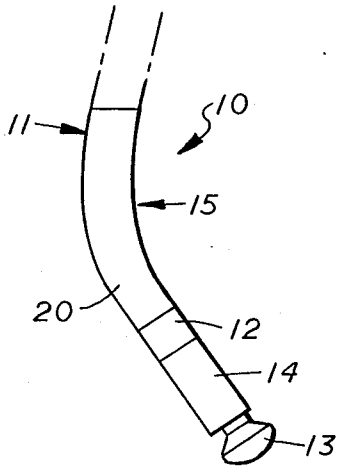
FIG. 9 is a schematic side elevation of the present system illustrating a downhole fluid-operated motor having a curved motor drive section.

The novel features of the present invention can be best understood by a brief description of prior art apparatus commonly used in directional drilling systems.

Referring to the drawings by numerals of reference, there is shown in FIG. 1, a conventional fluid-operated drilling motor of the prior art used for straight and slanted hole drilling operations. Conventional motors, such as a Moineau motor comprise three sections, the rotor/stator section which contains a rubber stator and a steel rotor; the universal section which contains the universal joints or flexible connection that convert the orbiting motion of the rotor to the concentric rotary motion of the bit; and the bearing pack section which contains radial and thrust bearings to absorb the high loads applied to the drill bit.

In such apparatus a fluid, usually a relatively incompressible liquid, is forced down the stationary drill pipe or drill string and on passing through the fluid-operated motor causes the thereof to rotate the drilling bit. The drill string is held or suspended in such a manner that it does not rotate and therefore may be regarded as stationary. However, it is lowered in the well as drilling proceeds. The forces required to rotate the rotary bit at the bottom of the string are such that in the usual situation the fluid operated motor must be quite lengthy. The rotor/stator section of conventional motors is typically 2–3 times longer than the bearing pack section.

Drilling motors of this general character are used in directional drilling, however, because the rotor/stator section of the motors are typically 2–3 times longer than the bearing section, the conventional motor systems are not particularly suitable for use in drilling high curvature horizontal wellbores, such as medium-radius (200 to 1,000 feet), from vertical or near vertical wells.

As shown in FIG. 2, some directional drilling systems position a "bent sub" between the top of the fluid-operated motor and the axis of rotation of the bit to the axis of the drill pipe. However, due to the length of the motor required and other structure connecting the rotor of the motor to the bit, the spacing of the "bent sub" from the bit is excessive. Frequently, this distance amounts to approximately 22 feet or more which is objectionable due to the fact that it is difficult to position and to maintain the orientation of the bit in relation to the axis of the drill pipe.

Other systems attempt to solve this problem by placing the bend closer to the bit as shown in FIG. 3. These types of systems modify the universal section of the drilling motor. Because the lower end of the rotor in the aforementioned types of motors gyrate about the axis of its stator, some form of universal joint or flexible connection is employed in the driving connection between the rotor and the bit which rotates about a stationary axis.

As a clearance must exist between this universal joint or flexible connection and the walls of the surrounding housing to accommodate the flexibility of movement, a bend is formed in the housing of the universal section of the motor. In this manner, the axis of rotation of the bit is angularly related not only to the axis of the drill string but also the axis of the fluid-operated motor. However, the bend is located below the motor drive section and above the motor bearing pack section.

Still other systems, such as depicted in FIG. 4, utilize a straight drilling motor with the bit or output shaft angularly offset relative to the longitudinal axis of the drive section.

FIG. 5 is a schematic side elevation illustrating the problem encountered with conventional drill string systems which utilize a straight fluid-operated drilling motor in combination with a bent sub or bent universal housing in drilling high curvature wellbores.

As shown in FIGS. 6–10, the present invention is distinguished over the prior art by a system which utilizes a downhole fluid-operated motor having a bent or curved rotor/stator drive section which allows it to be used in high curvature wellbore applications without interfering with the wall of the borehole.

The present system 10 comprises a downhole fluidoperated motor 11 having a straight universal section 12 which contains the universal joints or flexible connection attached at its lower end to the drill bit 13 and which converts the orbiting motion of the rotor to the concentric rotary motion of the bit. The motor 11 has a straight bearing pack section 14 at the lower end of the universal section which contains radial and thrust bearings to absorb the high loads applied to the drill bit 13. The motor drive section, or rotor/stator section 15 of the motor 11 contains a rubber stator 16 and a steel rotor 17 within the outer housing 18 of the drive section. The motor is preferably of the Moineau configuration but the housing 18 and stator 16 are bent or curved and the rotor 17 is straight. The flexibility of the rotor shaft 17 and compressibility of the rubber stator 16 permit rotation of the rotor without undue binding.

Figure 8:
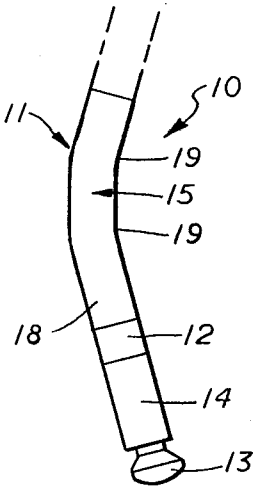
FIG. 8 is a schematic side elevation of the present system illustrating a downhole fluid-operated motor having multiple bends in the motor drive section.
Figure 7:
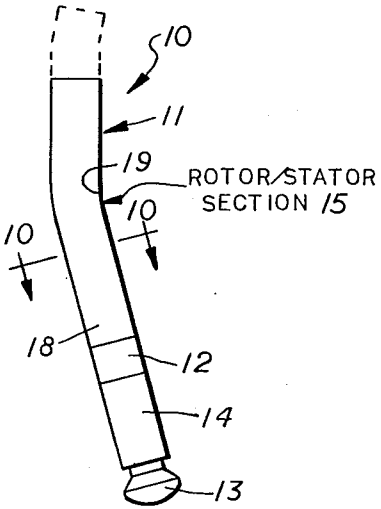
FIG. 7 is a schematic side elevation of the present system illustrating a downhole fluid-operated motor having a single bend in the motor drive section.
Figure 10:
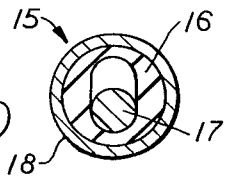
FIG. 10 is a transverse cross-section taken along lines 10—10 of FIG. 7 showing the rotor/stator section of the fluid-operated motor.

FIG. 7 shows one embodiment of the motor 11 wherein the rotor/stator outer housing 18 has a single bend 19. FIG. 8 illustrates a modification of the downhole fluid-operated motor 11 having multiple bends 19 vertically spaced in the outer housing 18 of the rotor/-stator drive section. Another modification is shown in FIG. 9 wherein the downhole fluidoperated motor 11 has a curved rotor/stator outer housing 20.

A fluid, usually a relatively incompressible liquid, is forced down the stationary drill pipe or drill string and on passing through the fluid-operated motor 11 causes the rotor I7 thereof to rotate the drilling bit 13. The drill string is held or suspended in such a manner that it does not rotate and therefore may be regarded as stationary and the drill string is lowered in the well as drilling proceeds.

Although rotor/stator section of the motor 11 is still approximately 2–3 times longer than the bearing pack section, the bent or curved section is located in the long drive section of the motor between the drill pipe and the universal section of the motor. In this manner, the bit or output shaft is angularly offset relative to the drive pipe axis over a sufficient linear distance making it particularly suitable for use in drilling high curvature horizontal wellbores, such as medium-radius (200 to 1,000 feet) from vertical or near vertical wells.

Tests conducted on motors according to the present invention which have sharp bends or curved rotor/stator drive sections have demonstrated that they deliver approximately 90 to 95 percent as much power as motors having a straight drive section, therefore loss of power is not a significant problem.

While this invention has been described fully and completely with special emphasis upon a preferred embodiment, it should be understood that within the scope of the appended claims the invention may be practiced otherwise than as specifically described herein.

We claim:

1. A system of apparatus for the drilling of a deviated wellbore into the earth comprising;

a drill string extending into a well bore in the earth, a fluid operated drill motor and drill bit operatively secured on the bottom end of said drill string, said drill motor being connected at its upper end to said drill string and at its lower end to said drill bit for rotating said drill bit independently of rotation of said drill string, said drill motor having a tubular drive section housing with the longitudinal axis of its upper end angularly displaced from the longitudinal axis of its lower end for directing the axis of rotation of said drill bit such that it is angularly displaced from the axis of said drill string for effecting a curved path for said wellbore, said motor comprises a rubber stator in said housing and a steel rotor rotatable therein, said stator having an upper end and a lower end, the longitudinal axis of its upper end angularly displaced from the longitudinal axis of its lower end such that said stator fits the angular configuration of said housing, and said drill motor drive section housing directs the axis of said drill bit to effect a curved path having a radius of curvature of from approximately 200 to approximately 1,000 feet relative to a substantially vertical wellbore.

2. A system of apparatus according to claim 1 in which said motor drive section housing has a single bend intermediate its upper and lower ends.

3. A system of apparatus according to claim 1 in which said motor drive section housing has a plurality of vertically spaced bends between its upper and lower ends.

4. A system of apparatus according to claim 1 in which said motor drive section housing gradually curves between its upper and lower ends.

5. A system of apparatus according to claim 1 in which said drilling motor is a fluid-operated drilling motor including a rotor/stator section containing a rubber stator and a steel rotor, said rotor/stator section having a tubular housing having a single bend intermediate its upper and lower ends so that the longitudinal axis of its upper end is angularly displaced from the longitudinal axis of its lower end for directing the axis of rotation of said drill bit such that it is angularly displaced from the axis of said drill string for effecting a curved path for said wellbore, said stator being bent with said housing, said rotor being straight, and said rotor being sufficiently flexible and said stator being sufficiently compressible to permit rotation of said rotor without undue binding.

6. A system of apparatus according to claim 1 in which said drilling motor is a fluid-operated drilling motor including a rotor/stator section containing a rubber stator and a steel rotor, said rotor/stator section having a tubular housing having a plurality of vertically spaced bends between its upper and lower ends so that the longitudinal axis of its upper end is angularly displaced form the longitudinal axis of its lower end for directing the axis of rotation of said drill bit such that it is angularly displaced from the axis of said drill string for effecting a curved path for said wellbore, said stator being bent with said housing, said rotor being straight, and said rotor being sufficiently flexible and said stator being sufficiently compressible to permit rotation of said rotor without undue binding.

7. A system of apparatus according to claim 1 in which said drilling motor is a fluid-operated drilling motor including a rotor/stator section containing a rubber stator and a steel rotor, said rotor/stator section having a tubular housing which gradually curves between its upper and lower ends so that the longitudinal axis of its upper end is angularly displaced from the longitudinal axis of its lower end for directing the axis of rotation of said drill bit such that it is angularly displaced from the axis of said drill string for effecting a curved path for said wellbore.

8. A system of apparatus according to claim 1 in which said drilling motor is a fluid-operated drilling motor including a rotor/stator section containing a rubber stator and a steel rotor, said rotor/stator section having a tubular housing which gradually curves between its upper and lower ends so that the longitudinal axis of its upper end is angularly displaced from the longitudinal axis of its lower end for directing the axis of rotation of said drill bit such that it is angularly displaced from the axis of said drill string for effecting a curved path for said wellbore, said stator being curved with said housing, said rotor being straight, and said rotor being sufficiently flexible and said stator being sufficiently compressible to permit rotation of said rotor without undue binding.

9. A system of apparatus according to claim 1 in which said drilling motor is a fluid-operated drilling motor comprising a rotor/stator section containing a rubber stator and a steel rotor, a straight universal section therebelow which contains flexible connection means for converting orbiting motion of the rotor to concentric rotary motion at said drill bit, and a bearing pack section below the universal section containing radial and thrust bearings to absorb the high loads applied to said drill bit, said rotor/stator section having a tubular housing with the longitudinal axis of the upper end angularly displaced from the longitudinal axis of the lower end for directing the axis of rotation of said drill bit such that it is angularly displaced from the axis of said drill string for effecting a curved path for said wellbore, and said rotor being sufficiently flexible and said stator being sufficiently compressible to permit rotation of said rotor without undue binding.

10. A system of apparatus according to claim 9 in which the length of said rotor/stator section housing is from 2 to 3 times the length of said bearing pack section.

11. A fluid operated drill motor for the drilling of a deviated wellbore into the earth comprising;

a motor housing having a rotor/stator drive section with the longitudinal axis of one end angularly displaced from the longitudinal axis of the other end, a rubber stator in said housing rotor/stator drive section and a steel rotor rotatable therein, said stator having an upper end and a lower end, the longitudinal axis of its upper end angularly displaced from the longitudinal axis of its lower end such that said stator fits the angular configuration of said housing rotor/stator drive section, said motor being adapted to be supported on a drill string in a well bore and to support a drill bit on said rotor, whereby the axis of rotation of the drill bit is angularly displaced from the axis of the drill string for drilling the wellbore in a curved path on rotation of the rotor and bit and advancing the same into the wellbore, and said drive section housing has an angular displacement sufficient to direct the axis of the drill bit in a curved path having a radius of curvature of from approximately 200 to approximately 1,000 feet relative to a substantially vertical wellbore.

12. A fluid operated drill motor for the drilling of a deviated wellbore into the earth according to claim 11 in which said motor drive section housing has a single bend intermediate its upper and lower ends.

13. A fluid operated drill motor for the drilling of a deviated wellbore into the earth according to claim 11 in which said rotor/stator housing drive section housing has a plurality of vertically spaced bends between its upper and lower ends.

14. A fluid operated drill motor for the drilling of a deviated wellbore into the earth according to claim 11 in which said motor drive section housing gradually curves between its upper and lower ends.

15. A fluid operated drill motor for the drilling of a deviated wellbore into the earth according to claim 11 in which said rotor/stator housing drive section is bent, said stator being bent with said housing, said rotor being straight, and said rotor being sufficiently flexible and said stator being sufficiently compressible to permit rotation of said rotor without undue binding.

16. A fluid operated drill motor for the drilling of a deviated wellbore into the earth according to claim 11 in which said rotor/stator housing drive section is bent, said stator being bent with said housing, said rotor being straight, said rotor being sufficiently flexible and said stator being sufficiently compressible to permit rotation of said rotor without undue binding, said motor having a bearing pack section through which the rotor extends, and the length of said rotor/stator section housing is from 2 to 3 times the length of said bearing pack section.

* * * * *